US006919673B2

(12) United States Patent
Takahashi et al.

(10) Patent No.: US 6,919,673 B2
(45) Date of Patent: Jul. 19, 2005

(54) COLOR CATHODE RAY TUBE AND METHOD OF MANUFACTURING THE SAME

(75) Inventors: Tohru Takahashi, Saitama (JP); Masatsugu Inoue, Kumagaya (JP); Kumio Fukuda, Fukaya (JP); Masaru Nikaido, Yokosuka (JP); Hitoshi Shiozawa, Honjo (JP); Akiyoshi Nakamura, Saitama (JP); Satoshi Ishikawa, Fukaya (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 130 days.

(21) Appl. No.: 10/239,247

(22) PCT Filed: Jan. 25, 2002

(86) PCT No.: PCT/JP02/00567

§ 371 (c)(1),
(2), (4) Date: Sep. 20, 2002

(87) PCT Pub. No.: WO02/061794

PCT Pub. Date: Aug. 8, 2002

(65) Prior Publication Data

US 2004/0160158 A1 Aug. 19, 2004

(30) Foreign Application Priority Data

Jan. 30, 2001 (JP) ..... 2001-022165
Jul. 2, 2001 (JP) ..... 2001-201284

(51) Int. Cl.[7] ..... H01J 29/80
(52) U.S. Cl. ..... 313/402; 313/408
(58) Field of Search ..... 313/402–408

(56) References Cited

U.S. PATENT DOCUMENTS 3,789,470 A * 2/1974 Owaki et al. ..... 445/25
4,066,923 A 1/1978 Van Esdonk
4,107,569 A 8/1978 Ronde
4,121,131 A 10/1978 Van Esdonk et al.
4,222,159 A * 9/1980 Koorneef ..... 445/31
4,427,918 A 1/1984 Lipp
4,458,174 A 7/1984 De Keijzer
4,536,226 A * 8/1985 Ohtake et al. ..... 148/621
4,621,214 A 11/1986 Bloom et al.
4,629,932 A 12/1986 Tokita
4,713,575 A * 12/1987 Knapp et al. ..... 313/400
4,734,615 A 3/1988 Koike et al.
4,931,689 A * 6/1990 Van Uden ..... 313/402
5,841,223 A * 11/1998 Muramatsu et al. ..... 313/402

FOREIGN PATENT DOCUMENTS

| | | |
|---|---|---|
| GB | 1 496 949 | 1/1978 |
| JP | 52-87970 | 7/1977 |
| JP | 52-87972 | 7/1977 |
| JP | 52-89068 | 7/1977 |
| JP | 56-3951 | 1/1981 |
| JP | 60-79645 | 5/1985 |
| JP | 60-107241 | 6/1985 |
| JP | 63-62129 | 3/1988 |

* cited by examiner

*Primary Examiner*—Nimeshkumar D. Patel
*Assistant Examiner*—German Colón
(74) *Attorney, Agent, or Firm*—Pillsbury Winthrop Shaw Pittman, LLP

(57) ABSTRACT

A shadow mask is arranged to face a phosphor screen formed on an inner surface of a panel. A plurality of aperture columns are formed in parallel in the shadow mask. Each aperture column includes a plurality of apertures arranged in line at a predetermined interval. On both sides of each aperture column on the surface of the shadow mask facing the electron gun, stripe-shaped dielectric layers for acting on electron beams toward the apertures are formed respectively, and extend in substantial parallel with the aperture columns. The shadow mask is manufactured in such a manner that stripe-shaped insulating material layers are formed on the surface of a mask base material facing the electron gun, the mask base material is thereafter shaped into a predetermined shape, and the insulating material layers on the shaped mask are sintered.

16 Claims, 6 Drawing Sheets

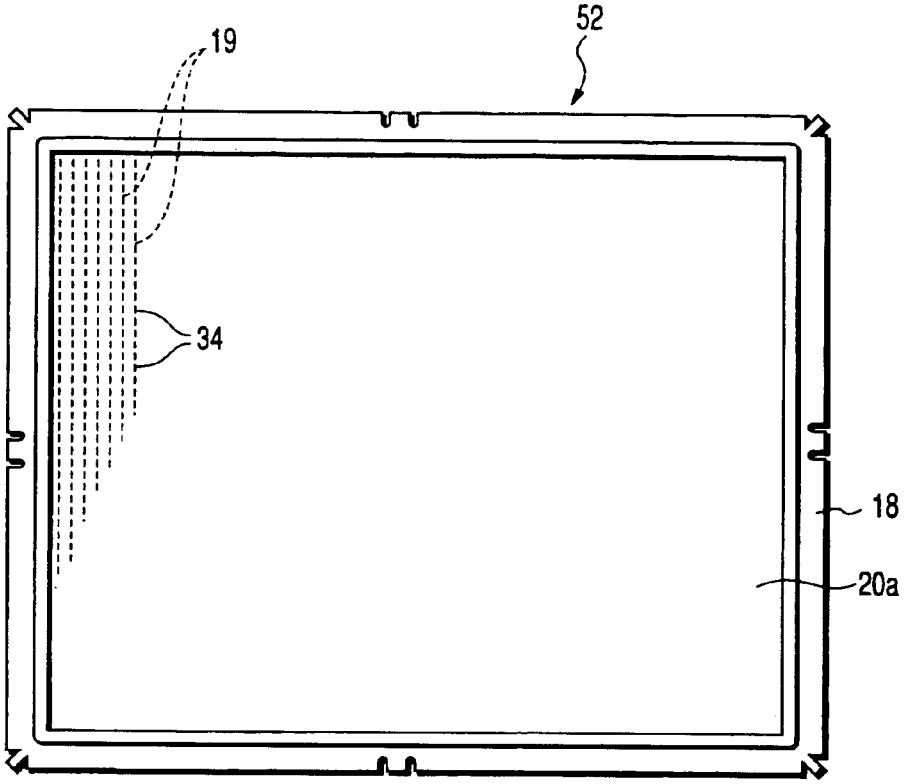
FIG. 11
FIG. 12
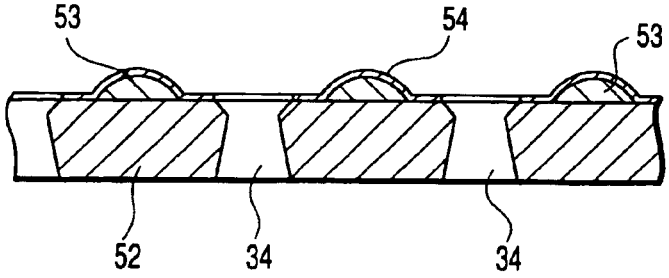
FIG. 13
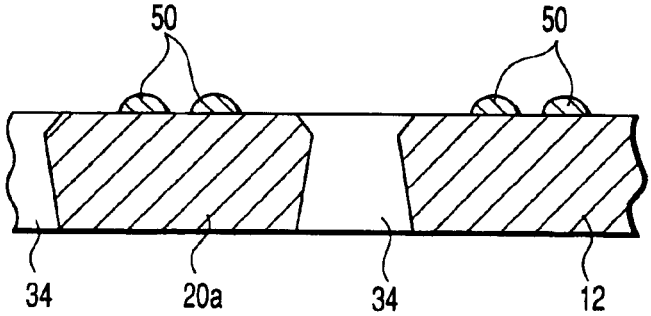

COLOR CATHODE RAY TUBE AND METHOD OF MANUFACTURING THE SAME

CROSS-REFERENCE TO RELATED APPLICATIONS

This application is based upon and claims the benefit of priority from the prior Japanese Patent Applications No. 2001-022165, filed Jan. 30, 2001; and No. 2001-201284, filed Jul. 2, 2001, the entire contents of both of which are incorporated herein by reference.

TECHNICAL FIELD

The present invention relates to a color cathode ray tube and a method of manufacturing the same.

BACKGROUND ART

In general, a color cathode ray tube is provided with a vacuum envelope including a substantially rectangular panel and a funnel. A phosphor screen is formed on the inner surface of an effective portion of the panel. A substantially rectangular shadow mask is provided in the vacuum envelope, facing the phosphor screen.

In the neck of the funnel, an electron gun which emits electron beams is provided. Further, in the color cathode ray tube, three electron beams emitted from the electron gun are deflected by a deflection yoke mounted on the outside of the funnel, and scan the phosphor screen horizontally and vertically through electron beam passage apertures of the shadow mask, thereby displaying a color image. At this time, the apertures of the shadow mask select and allow the three electron beams to land on desired ones of three color phosphor layers which construct the phosphor screen.

The shapes of the electron beam passage aperture can be roughly divided into two types, i.e., a circular shape and a rectangular shape. Display tubes which display text and figures mainly use a shadow mask having circular apertures. Home-use picture tubes used generally at home mainly have a shadow mask including rectangular apertures. In any case, each of the apertures is basically defined by a through hole which includes a large hole opened in the surface of the shadow mask facing the phosphor screen and a small hole opened in the surface facing the electron gun. The large and small holes are connected with each other.

An important characteristic of this kind of color cathode ray tube will be luminance of the screen. In order to improve the luminance of the color cathode ray tube, various techniques have conventionally been discussed. Techniques which have been taken over today will be adoption of a metal back layer provided on the surface of the phosphor screen facing the electron gun, use of various high-luminance phosphor materials, and the like.

In recent years, there is a known method in which the luminance is improved by increasing the high voltage called Eb of the color cathode ray tube to respond to large screens. This Eb is a voltage which is applied to the phosphor screen, shadow mask, and inner surface of the funnel of the color cathode ray tube. By increasing Eb, the speed of the electron beams is increased so that energy of collision to the phosphor material can be increased. As a result of this, the luminance based on the phosphor material is improved.

In case of increasing Eb, however, the passing time of the electron beams which penetrate through a magnetic filed generated by the deflection yoke is shortened, and accordingly, the deflection range of the electron beams is reduced. Consequently, in this case, the deflection power must be increased undesirably from the viewpoint of energy saving.

Further, improvements in luminance by a method called a focus mask have conventionally been tried although the method has not yet been put into practice. In the following, explanation will be made of principles of the focus mask.

A color cathode ray tube which is considered as a main trend today comprises internally a shadow mask which functions as a color selection electrode, as described above. Further, electron beams emitted from an electron gun are subjected to scanning by a deflection yoke. Thereafter, the electron beams partially pass through apertures of the shadow mask and collide into the phosphor surface. At this time, about 20% of total electron beams emitted from the electron gun passes through the apertures of the shadow mask. The other remaining portion of about 80% merely collides into the shadow mask but does not contribute to the luminance of the screen. The focus mask has an object of making the electron beams which thus collide into the shadow mask reach the phosphor surface.

More specifically, in case of a focus mask, electrodes are provided on the surface of the shadow mask on the side facing the electron gun. A different potential from that to the shadow mask is applied to these electrodes, and a four-pole lens is constructed by the shadow mask and the electrodes. The four-pole lens changes the path of the electron beams to guide the electron beams to the phosphor surface.

For example, as disclosed in Japanese Patent Application KOKAI Publications No. 52-87970, No. 52-87972, No. 52-89068, and No. 56-3951, and U.S. Pat. No. 4,427,918, there has been proposals for a structure in which an insulating layer is provided on the side of the shadow mask facing the electron gun and electrodes are formed on the insulating layer. The manufacturing method thereof is disclosed in Japanese Patent Application KOKAI Publication No. 63-62129 and the like.

However, in the structure shown in Japanese Patent Application KOKAI Publications No. 52-87970, No. 52-87972, No. 52-89068, and No. 56-3951, both electrodes are made of metal plates. It is difficult to position precisely those two electrodes over the entire area of the screen.

In another structure according to the known publications as described above, two bamboo-blind-like electrodes are arranged to be perpendicular to each other, thereby to form apertures of the shadow mask. In this structure, however, it is difficult to form the curved surface of the shadow mask. At the same time, the apertures of the shadow mask cannot substantially be arranged in a stagger array in which the apertures are shifted at ½ pitch in the longitudinal direction of the apertures. If the apertures cannot be in a stagger array, interference fringes called moiré appear on the screen, so that the display quality of the screen is greatly degraded, leading to poor realization.

Further, in the structure disclosed in the U.S. Pat. No. 4,427,918, there is formed a part called a ridge in which the height of a non-hole part extending in the column direction of the apertures of the shadow mask is arranged to be greater than that of the other part. An electrode is formed thereon. In this structure, it is substantially impossible to change partially the shape of the electrode. It is therefore difficult to vary the electrode layout between the screen center part and the peripheral part of the screen. If this structure is used in a color cathode ray tube, it cannot be considered that an excellent convergence effect on electron beams is obtained over the entire screen.

Also, this structure is the same as that in the case of using a shadow mask material having a thicker plate thickness than that of a conventional structure. There is a risk that a part of the electron beams deflected toward the peripheral region of the screen collides into the ridge part of the shadow mask. In this case, a shadow generally called an eclipse appears. It is hence estimated that improvements of the luminance at the periphery of the screen are degraded.

As has been described above, in case of a focus mask which has conventionally been proposed, high precision is required in formation of electrodes and it is difficult to form the shadow mask surface in a desired shape. In addition, there is a problem that the degree of freedom is low in formation of electrodes, so that control of electron beams is substantially impossible.

DISCLOSURE OF INVENTION

The present invention has been made in view of the above problems and its object is to provide a color cathode ray tube and a method of manufacturing the same, which improve the focus characteristic of electron beams over the entire screen area so that the luminance of the entire screen can be improved.

To achieve the above object, a color cathode ray tube according to an aspect of the present invention comprises: an envelope including a panel with a phosphor screen formed on an inner surface of the panel; an electron gun arranged in the envelope, for emitting electron beams toward the phosphor screen; a shadow mask which is provided facing the phosphor screen and has a number of apertures for selecting the electron beams; and dielectric layers provided on a surface of the shadow mask on a side facing the electron gun, the dielectric layers being positioned on both sides of each of the apertures to be charged by irradiation of the electron beams and to form an electron lens for acting the electron beams.

Meanwhile, a method of manufacturing a color cathode ray tube, according to the present invention is for a color cathode ray tube comprising an envelope including a panel with a phosphor screen formed on an inner surface of the panel, an electron gun arranged in the envelope, for emitting electron beams toward the phosphor screen, and a shadow mask which is provided facing the phosphor screen and has a plurality of aperture columns arranged in substantially parallel and each including a plurality of apertures provided at a predetermined interval, to select the electron beams emitted from the electron gun; and stripe-shaped dielectric layers provided on a surface of the shadow mask on a side facing the electron gun, the dielectric layers being arranged on both sides of each of the aperture columns and extending substantially in parallel to the aperture columns to be charged by irradiation of the electron beams and to form an electron lens which acts on the electron beams.

The method comprises: preparing a plate-like mask base material in which the apertures columns are formed; forming stripe-shaped insulating material layers on both sides of each of the apertures on a surface of the mask base material facing the electron gun; shaping the mask base material on which the insulating material layers are formed, into a predetermined shape, thereby to form the shadow mask; and sintering the insulating material layers on the shaped shadow mask, to form the dielectric layers.

According to the color cathode ray tube structured as described above, when electron beams are irradiated on the dielectric layers during operation, each dielectric layer is charged to minus and forms an electron lens which acts on the electron beams. When electron beams pass the apertures of the shadow mask, the beams pass between dielectric layers provided on both sides of each apertures, receive reaction forces from both sides by the dielectric layers, and are thereby converged toward the aperture. In this manner, the portion of the electron beams traveling toward the apertures, which conventionally collides into the shadow mask, can be converged toward the apertures so as to pass the apertures. Accordingly, the amount of electron beams which pass through the apertures increases so that the density of the electron beams which reach the phosphor screen is raised thereby improving the luminance on the screen.

Also, according to the color cathode ray tube structured as described above, the electron beams are converged by the dielectric layers provided on both sides of each aperture. Hence, it is unnecessary to provide conventional electrodes and it is also unnecessary to position those electrodes in relation to each other. Simultaneously, by adjusting the layout position, width, height, dielectric constant, and the like of each dielectric layer, the charge amount of dielectric layers and the forces of dielectric layers acting on electron beams can be adjusted, so that the focus state of electron beams can be controlled easily.

Further, the focus state of electron beams may be controlled so that the electron beams are converged in the horizontal direction and diverged in the vertical direction. With this focus state of electron beams, a problem under interference fringes called moiré can be easily prevented in a shadow mask having bridge portions.

It is therefore possible to obtain a color cathode ray tube which can be manufactured easily and can attain an excellent focus state over the entire screen area.

Further, according to the method of manufacturing a color cathode ray tube according to the present invention, insulating material layers are formed on a mask base material, and thereafter, the mask base material is shaped. Hence, a shadow mask having a desired shape can be attained easily. Further, when forming the insulating material layers on the mask base material, it is possible to adjust freely the width of the insulating material layers and the position thereof relative to apertures. This enables grading the positions of the dielectric layers between the center part and the peripheral part of the shadow mask, so that the dielectric layers are provided in compliance with the focus state of the electron beams. Accordingly, it is possible to manufacture a color cathode ray tube in which an excellent focus state is obtained over the entire screen area and the luminance is improved.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF DRAWINGS

The accompanying drawings, which are incorporated in and constitute a part of the specification, illustrate of the invention, and together with the general description given above and the detailed description of the embodiment given below, serve to explain the principles of the invention.

FIG. 11 is a plan view showing a mask base material used for manufacturing the shadow mask;

FIG. 12 is a cross-sectional view showing a state in which an overcoat layer is formed on a surface of the mask base material in the side facing the electron gun assembly, in a step of manufacturing the shadow mask; and FIG. 13 is a cross-sectional view showing an enlarged part of a shadow mask applicable to a color cathode ray tube according to a modification of the present invention.

BEST MODE FOR CARRYING OUT OF THE INVENTION

Hereinafter, a color cathode ray tube according to an embodiment of the present invention will be explained in details with reference to the drawings.

Figure 1:
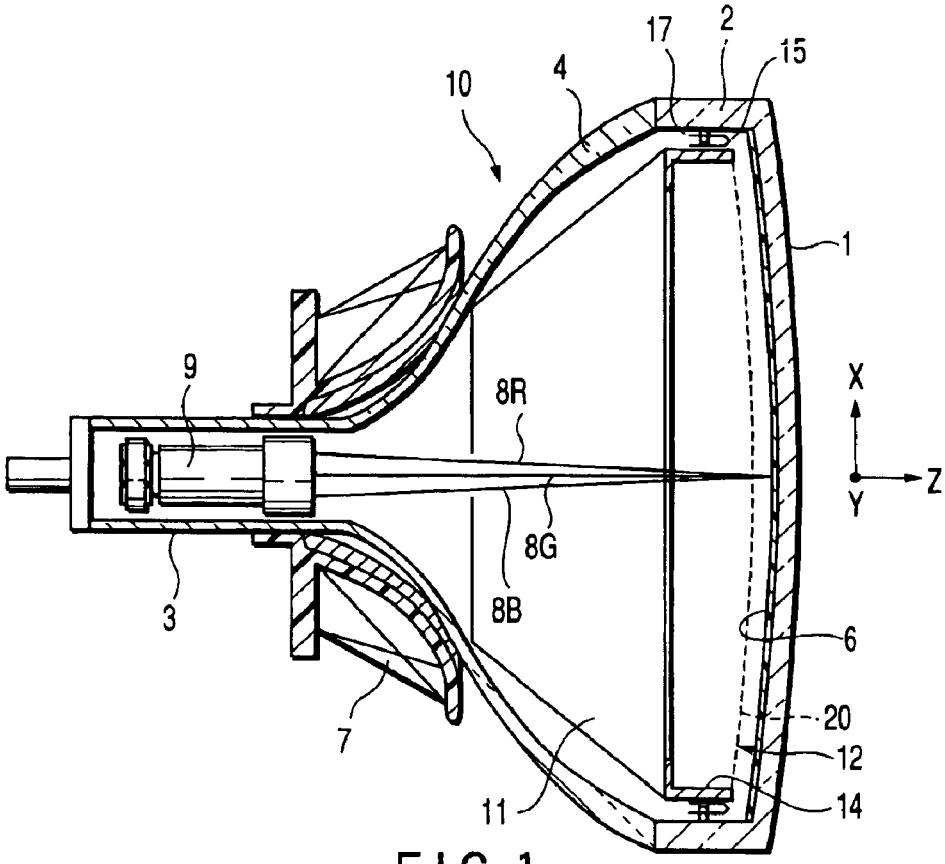
FIG. 1 is a horizontal cross-sectional view schematically showing the structure of a color cathode ray tube according to an embodiment of the present invention.

As shown in FIG. 1, the color cathode ray tube comprises a vacuum envelope 10. The vacuum envelope 10 has a panel 1, which has a skirt portion 2 at its periphery and a substantially rectangular outer surface, a funnel 4 joined to the skirt portion of the panel, and-a cylindrical neck 3 connected to a small-diameter part of the funnel.

A phosphor screen 6 is formed on the inner surface of the panel 1. A deflection yoke 7 having horizontal and vertical deflection coils are mounted on the outer circumference of the envelope from the neck 3 to the funnel 4. An electron gun 9 which emits three electron beams 8R, 8G, and 8B toward the phosphor screen 6 is provided in the neck 3. The electron gun 9 emits three electron beams 8 (B, G, and R) in the tube axis direction Z. The electron beams include a center beam 8G and paired side beams 8B and 8R on both sides of the center beam, passing in one same horizontal plane, and are arranged in line in the horizontal axis direction X. An inner shield 11 is provided inside the connection part where the panel 1 and the funnel 4 are joined to each other.

A shadow mask 12 is arranged in the vacuum envelope 10, opposed to the phosphor screen 6, and is attached to a rectangular mask frame 14. This shadow mask 12 has a mask main surface 20 where a large number of electron beam passage apertures (hereinafter called apertures) for color selection are formed, and a skirt portion 18 extending from the periphery of the mask main surface 20 and fixed to the mask frame 14. The mask main surface 20 and the skirt portion 18 will be described later. The shadow mask 12 is detachably supported on the panel in a manner that elastic support members 15 fixed to the mask frame 14 are. engaged with respective stud pins 17 provided on the inner surface of the skirt portion 2 of the panel 1.

The vacuum envelope 10 including the panel 1 and the shadow mask 12 has a tube axis Z extending through the center of the panel and the electron gun 9, a long axis (horizontal axis) X extending perpendicularly to the tube axis, and a short axis (vertical axis) Y extending perpendicularly to the tube axis and the long axis.

In the color cathode ray tube constructed as described above, three electron beams 8B, 8G, and 8R emitted from the electron gun 9 are deflected by the deflection yoke 7 mounted on the outside of the funnel 4, thereby to scan horizontally and vertically the phosphor screen 6 through the electron beam passage apertures of the shadow mask 12, so that a color image is displayed.

Figure 2:
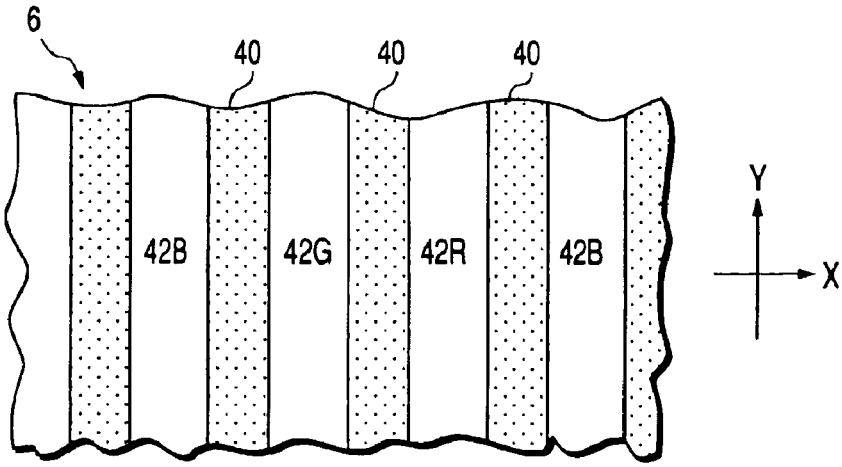
FIG. 2 is a plan view showing an enlarged part of a phosphor screen in the color cathode ray tube.

As shown in FIG. 2, the phosphor screen 6 has a plurality of stripe-shaped black light-absorption layers 40, and stripe-shaped three color phosphor layers 42B, 42G, and 42R. The black light-absorption layers 40 each extend in the short axis direction Y of the panel 1 and are arranged in parallel with a predetermined gap maintained between adjacent ones of the layers 40 interval in the long axis direction X. Each of the three color phosphor layers 42B, 42G, and 42R is provided at the gap between the light-absorption layers 40 and extend in the short axis direction Y.

Figure 3B:
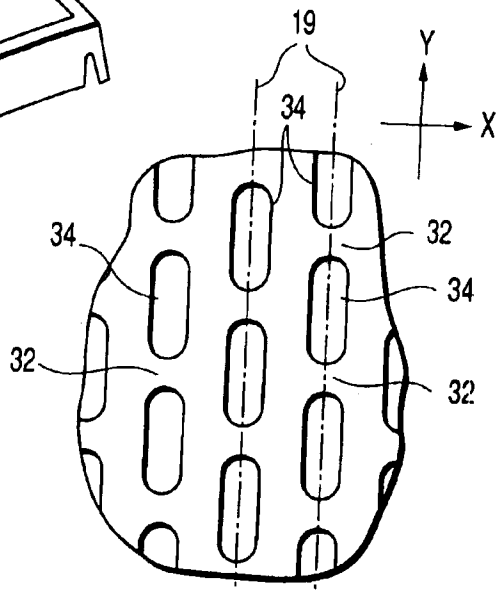
FIG. 3B is a plan view showing an enlarge part of the shadow mask.
Figure 3A:
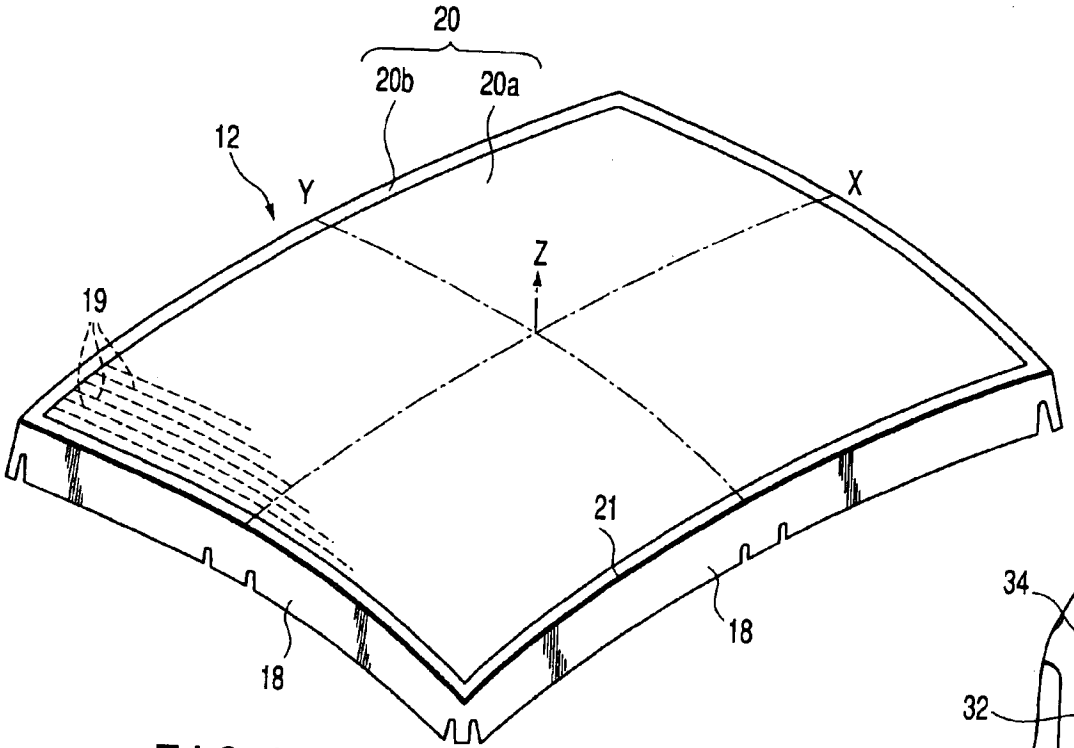
FIG. 3A is a perspective view schematically showing the structure of a shadow mask in the color cathode ray tube.

As shown in FIGS. 1 and 3B, the shadow mask 12 is formed by press-molding and integrally comprises a substantially rectangular mask main surface 20 shaped like a gentle dome, and a skirt portion 18 projecting from the periphery 21 of the mask main surface, substantially perpendicularly to the mask surface, over the entire circumference of the mask main surface. The mask main surface 20 has a substantially rectangular apertured region 20*a* where a large number of aperture columns 19 are formed at a predetermined array pitch, and a substantially rectangular frame-like non-apertured region 20*b* surrounding the periphery of the apertured region.

The aperture columns 19 extend in substantial parallel with the short axis Y and are provided in parallel with at a predetermined array pitch in the long axis direction X. In addition, each aperture column 19 is constructed by arranging a plurality of apertures 34 in line through a bridge 32. Each aperture 34 is formed in a substantially rectangular shape which is narrow and long, such that the width direction of each aperture is parallel to the long axis direction X of the shadow mask 12 and the length direction thereof is parallel to the short axis direction Y of the shadow mask. Also, each aperture 34 is defined by a through hole which includes a large hole opened in the surface of the shadow mask 12 on the side facing the phosphor screen, and a small hole opened in the surface of the mask in the side facing the electron gun. The larger and smaller holes communicate with each other.

Further, the apertures 34 in one aperture column 19 are shifted from other adjacent aperture columns at a pitch of ½ in the short axis direction Y, and are thus arrayed in a so-called stagger. The array pitch of the aperture columns 19 is set to different values between the center part of the apertured region 20*a* and the peripheral part in the long axis direction X. In particular, the array pitch gradually increases from the center part of the apertured region 20*a* toward the peripheral part in the long axis direction X.

In the embodiment, the shadow mask 12 is formed of Invar (Fe—Ni alloy) having a plate thickness of 0.22 mm. The aperture pitch in the short axis direction Y at each aperture column 19 is set to 0.6 mm. The array pitch of the aperture columns 19 in the long axis direction X is set as a variable pitch which increases from the center part of the mask toward the peripheral part in the long axis direction, wherein this pitch is 0.75 mm near the short axis Y and to 0.82 mm at the peripheral part in the long axis direction. The aperture size in the width direction is set to 0.46 mm with respect to large holes on the short axis Y, and to 0.50 mm with respect to large holes at the peripheral part in the long axis direction X. The aperture size in the width direction is set to 0.18 mm with respect to small holes on the short axis Y, and to 0.20 mm with respect to small holes at the peripheral part in the long axis direction X. Further, in case where the electron beams enter into the apertures 19 at the peripheral part in the long axis direction X at a deflection angle of 46°, these apertures are each formed into a shape whose large hole is deviated by 0.06 mm from the small hole.

According to the present embodiment, the shadow mask 12 comprises a plurality of stripe-shaped dielectric layers 50 provided on the surface of the apertured region 20*a* in the side facing the electron gun. These dielectric layers 50 have an average surface roughness of 0.2 $\mu$m or less, preferably 0.15 $\mu$m or less, and a dielectric constant of 3 or more, preferably 5 or more. In addition, the volume resistivity of the layers 50 is 1.0E+12 Ω·cm or more and 1.0E+15 Ω·cm or less, preferably 5.0E+12 Ω·cm or more and 7.5E+14 Ω·cm or less.

This average surface roughness is measured by a surface roughness meter, under condition that cut-off is 0.08 mm. The dielectric constant and the volume resistivity are measured based on JIS C2141 "Ceramic material test method for electric insulation".

More specifically, as shown in FIGS. 4 to 6B, a stripe-shaped dielectric layer 50 is formed between every adjacent aperture columns 19 on the surface of the apertured region 20*a* on the side facing the electron gun, that is, the dielectric layers 50 are formed on both sides of every opening column 19. Each layer 50 extends in a direction substantially parallel to the short axis Y of the shadow mask 12.

Each dielectric layer 50 has a semicircular cross-sectional shape, and is formed such that its width in the long axis direction X is about 0.25 mm and its height is about 0.03 to 0.05 mm, for example. The cross-sectional shape of the dielectric layer 50 is not limited to a semicircular but may be another shape such as a rectangle or the like.

In addition, each dielectric layer 50 is formed by sintering an insulating material containing glass as a main component. A preferable material is powder of lithium-based alkaline borosilicate glass. The dielectric layers 50 are formed by kneading the glass powder with a cellulose-based binder and a solvent to obtain glass paste, screen-printing the glass paste on the shadow mask, and drying/sintering it.

If the surface roughness, dielectric constant, and volume resistivity are proper, bismuth-based borosilicate glass, lead glass, or the like can be used in place of the lithium-based alkaline borosilicate glass.

These kinds of glass may contain an adjustment agent such as a pigment and the like to adjust the surface roughness, dielectric constant, and volume resistivity of the dielectric layer 50.

Figure 6A:
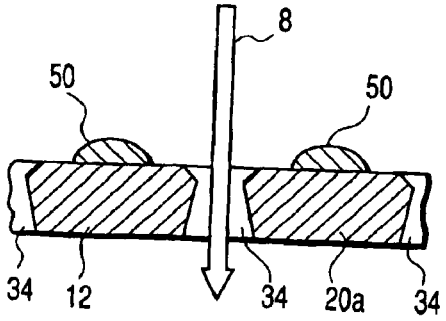
FIG. 6A is a cross-sectional view showing a cross-sectional structure of the shadow mask at a center part of a apertured region.

The positions of the dielectric layers 50 relative to the aperture columns 19 differ between the center part of the apertured region 20*a* and the peripheral part of the apertured region in the long axis direction X. As shown in FIG. 6A, each dielectric layer 50 is situated at the substantial center between adjacent two of aperture columns 19, at the center part of the apertured region 20*a*. Further, at the center part of the apertured region 20*a*, the electron beams 8 enter substantially perpendicularly to the surface of the shadow mask 12. It is therefore preferred that the dielectric layers 50 positioned on both sides of each aperture 34 are provided to be bilaterally symmetrical to each other with respect to the aperture 34.

Figure 6B:
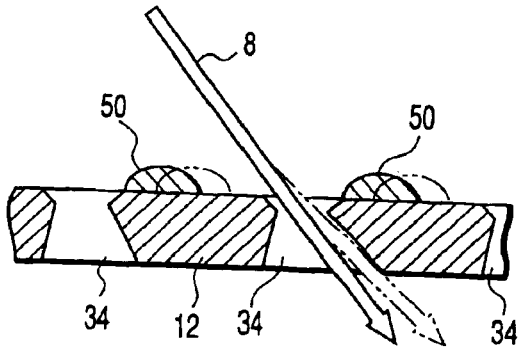
FIG. 6B is a cross-sectional view showing a cross-sectional structure of the shadow mask at a peripheral part of the apertured region in the long axis direction.

As shown in FIG. 6B, the dielectric layers 50 provided at the peripheral part of the apertured region 20*a* in the long axis direction X are positioned closer to the center part with respect to the aperture columns 19 than the dielectric layers provided at the center part of the apertured region 20*a*. More specifically, at the peripheral part in the long axis direction X of the apertured region 20*a*, each dielectric layer 50 provided between two adjacent aperture columns 19 is positioned to be close to the aperture column on the center side of the shadow mask.

According to the color cathode ray tube structured as described above, as shown in FIG. 7, the electron beams 8 emitted from the electron gun 9 partially collide into the dielectric layers 50 thereby charging the dielectric layers to minus, at the beginning of operation. Further, since the dielectric layers 50 are charged, a lower voltage than Eb as described above is applied to the dielectric layers. As a result of this, a potential difference occurs between the shadow mask 12 and the dielectric layers 50. Then, the potential difference, the dielectric layers 50, and the rectangular apertures 34 of the shadow mask 12 form a four-pole lens serving as an electron lens.

Figure 4:
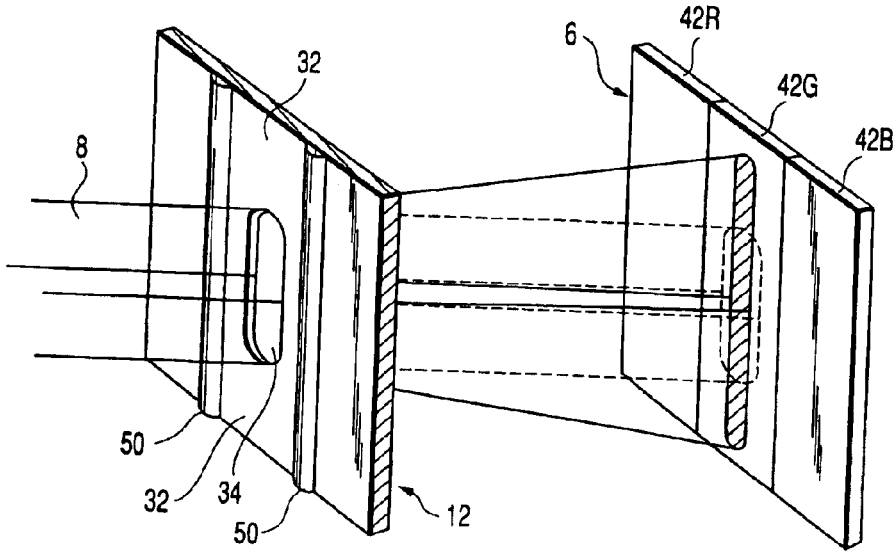
FIG. 4 is a perspective view schematically showing a relationship between the shadow mask, the phosphor screen, and electron beams.
Figure 7:
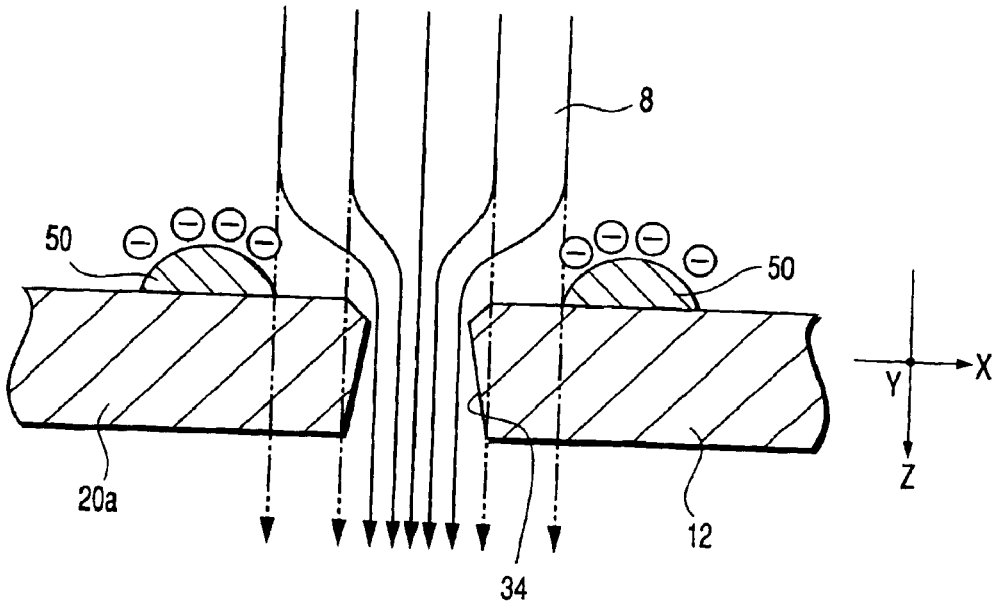
FIG. 7 is a cross-sectional view schematically showing a focus state of electron beams which pass through the center part of the apertured region of the shadow mask.

As shown in FIGS. 4 and 7, the four-pole lens has a function to focus the electron beams 8, which pass a space between two adjacent dielectric layers 50 toward the apertures 34, into an oblong shape which has a width narrower than the an actual aperture diameter in the width direction of the aperture 34 and has a length longer than an actual aperture diameter in the lengthwise direction thereof.

By thus focusing the electron beams 8 into an oblong shape, the portion of the electron beams that collides into the shadow mask in conventional cases can be let pass through the apertures 34 and guided to the phosphor screen 6. Further, in the lengthwise direction of the apertures 34, i.e., in the short axis direction Y of the shadow mask 12, the parts of the phosphor layer, which have shadowed by the bridges 32 of the shadow mask 12, are projected by electron beams and emit light. In the long axis direction X, the density of the beam spots can be raised. In this manner, the light emission luminance of the phosphor layer can be improved.

In addition, at the peripheral part of the apertured region 20*a* of the shadow mask, the dielectric layers 50 are arranged close to the aperture columns 19 on the side of the center part of the shadow mask, so that an effect substantially similar to the effect as described above can be obtained. As a result, an excellent convergence characteristic or focus characteristic can be obtained over the entire screen area.

That is, at the peripheral part of the apertured region 20*a* in the long axis direction X, the electron beams 8 enter obliquely into the surface of the shadow mask. Therefore, if the dielectric layers 50 provided on both sides of the apertures 34 are positioned to be bilaterally symmetrical to each other with respect to the apertures, as indicated by two-dot dashed lines in FIG. 6B, the electron beams 8 pass near the dielectric layers 50 on the side of the center part of the shadow mask and are influenced greatly from the dielectric layers 50. Therefore, the electron beams 8 are deflected by a greater deflection amount to the peripheral side of the apertured region 20*a* of the shadow mask, and are difficult to reach a predetermined position on the phosphor screen.

Hence, the electron beams 8 can be focused onto a desired phosphor layer by arranging the dielectric layers 50 closer to the aperture columns 19 on the side of the center part of the shadow mask, at the peripheral part of the apertured region 20*a* in the long axis direction X.

This effect is obtained by changing the layout of the dielectric layers 50 relative to the aperture columns 19, between the center part and the peripheral part of the apertured region 20*a*. However, the same effect can be obtained by changing the width, height, or dielectric constant of the dielectric layers 50 between the center part and the peripheral part of the apertured region 20*a* of the shadow mask. Thus, by suitably arranging the dielectric layers 50, the focus characteristic of the electron beams is controlled and an excellent focus characteristic can be attained over the entire area of the screen.

Figure 5:
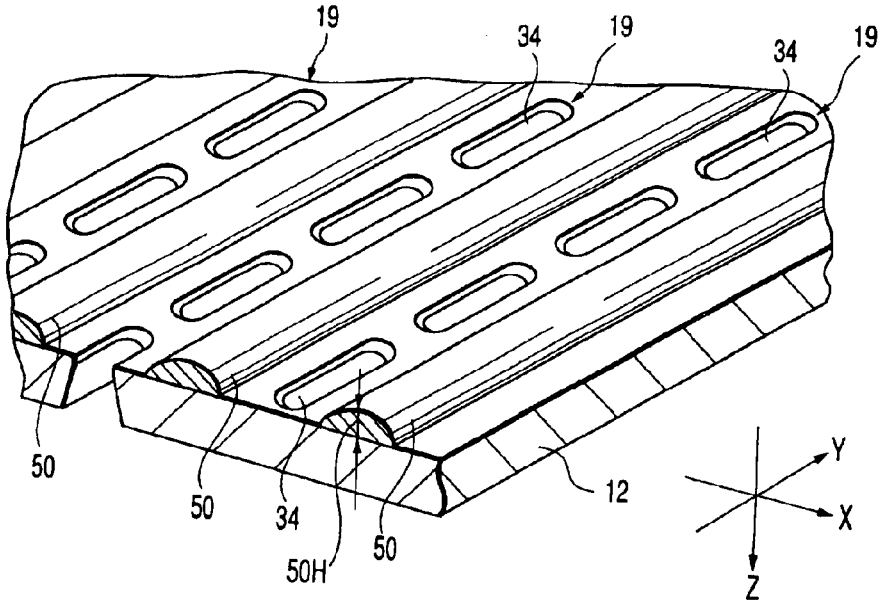
FIG. 5 is a perspective view schematically showing the structure of a surface of the shadow mask on the side facing the electron gun assembly, where dielectric layers are formed.

According to experiments made by the present inventors, if the color cathode ray tube is operated under the above-described conditions, the luminance can be improved by about 20% than the conventional cases. Also, according to the present embodiment, a sufficient effect can be obtained by providing dielectric layers 50 having a height of several tens $\mu$m with respect to the plate thickness of the shadow mask 12, i.e., by forming the dielectric layers 50 to have a part 50H having a maximum film thickness of 10 $\mu$m or more, as shown in FIG. 5. Therefore, the plate thickness of the shadow mask 12 need not be increased, and no care need be taken of eclipse as described previously.

In case where the film thickness of the dielectric layers 50 is smaller than 10 $\mu$ m, the dielectric layers 50 are charged by irradiation of electron beams, but it is not possible to form an electron lens having a lens strength enough to effect on the electron beams. The lower limit of the thickness of the dielectric layers need be determined in consideration of the dielectric constant and volume resistivity of the dielectric material, and workability in formation of the dielectric layers. As the dielectric constant becomes higher or the volume resistivity becomes greater, the same effect as described above can be obtained with dielectric layers having a thinner film thickness.

Meanwhile, the dielectric layers 50 are formed to have a dielectric constant of 3 or more or preferably 5 or more. If the dielectric constant is smaller than 3, it is not possible to form an electron lens having a lens strength enough to effect on the electron beams.

Figure 8:
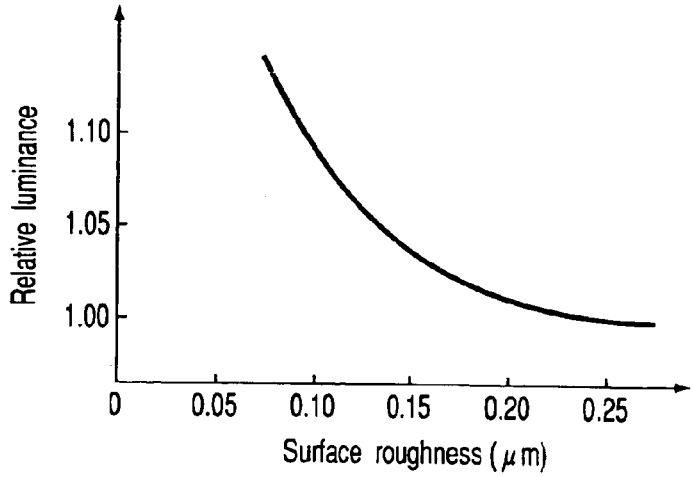
FIG. 8 is a graph showing a relationship of the relative luminance on the screen to the average surface roughness of the dielectric layers.

The dielectric layers 50 are formed to have an average surface roughness of 0.2 $\mu$m or less or preferably 0.15 $\mu$m or less. FIG. 8 is a graph showing the relationship between the average surface roughness and the relative luminance on the screen. The relative luminance is a relative value of the luminance of the screen of the cathode-ray tube comprising the dielectric layers 50, with respect to that of the cathode-ray tube wherein no dielectric layers are provided. As shown in FIG. 8, it is found that the relative luminance can be greatly improved by setting the average surface roughness of the dielectric layers 50 to 0.2 $\mu$m or less.

Figure 9:
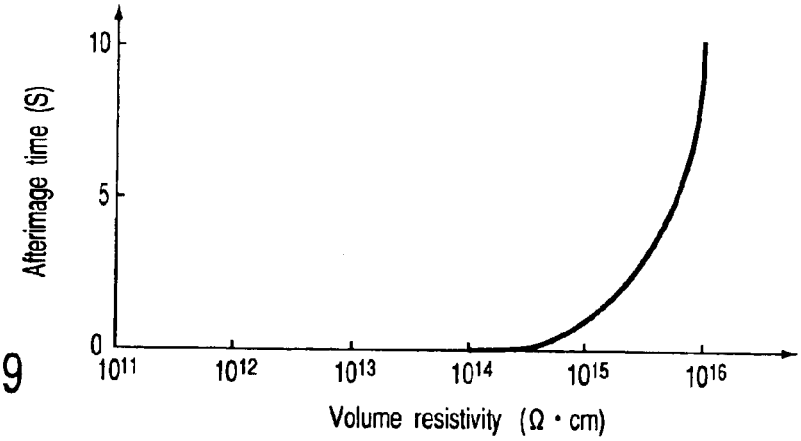
FIG. 9 is a graph showing a relationship of the afterimage time of a display image on the screen to the volume resistivity of the dielectric layers.

Also, the dielectric layers 50 are formed to have a volume resistivity of 1.0E+15 Ω·cm or less, preferably 7.5E+14 Ω·cm or less. FIG. 9 is a graph showing the relationship between the volume resistivity and an afterimage time of an image displayed on the screen. As shown in FIG. 9, if the volume resistivity of the dielectric layers 5 exceeds 1.0E+15 Ω·cm, the electric charges charged to the dielectric layers 50 are difficult to discharge through the shadow mask 12, and therefore, much time is required to charge/discharge the dielectric layers 50. The afterimage time is greatly elongated. In addition, when the irradiation amount of the electron beams is changed, landing positions of the electron beams tend to change easily, so that deterioration of color purity may be invited. In this respect, if the volume resitivity of the dielectric layers 50 is set to 1.0E+12 Ω·cm or less, the afterimage time can be reduced to 0.8 seconds or less.

Figure 10:
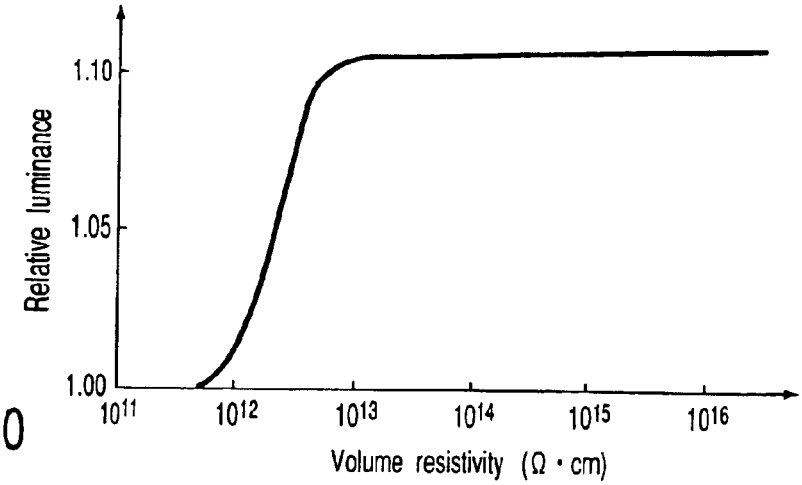
FIG. 10 is a graph showing a relationship of the relative luminance on the screen to the volume resistivity of the dielectric layers.

In addition, the dielectric layers 50 are formed to have a volume resistivity of 1.0E+12 Ω·cm or more, preferably 5.0E+12 Ω·cm. FIG. 10 is a graph showing the relationship between the volume resistivity and the relative luminance on the screen. As shown in FIG. 10, if the volume resistivity of the dielectric layers 50 is smaller than 1.0E+12 Ω·cm, the charged electrons are easily discharged and the electron lens cannot attain a sufficient lens strength although the dielectric layers 50 are charged by irradiation of electron beams. Therefore, it is not possible to attain a sufficient effect of converging the electron beams, and the luminance cannot be improved sufficiently. In contrast, if the volume resistivity of the dielectric layers 50 is set to 1.0E+12 Ω·cm or more, an electron lens having a sufficient lens strength can be formed so that the relative luminance on the screen can be improved greatly.

Next, explanation will be made of a method of manufacturing the color cathode ray tube structured as described above, and particularly a method of manufacturing the shadow mask.

At first, as shown in FIG. 11, a mask base material or flat mask 52 having a rectangular plate-shape is prepared, and a large number of apertures 34 are formed in the area to form the apertured region 20*a*, by etching like conventional cases. Subsequently, as shown in FIG. 12, stripe-shaped insulating material layers 53 are formed on both sides of each aperture column, on the surface of the mask base material 52 facing the electron gun.

In the present embodiment, glass paste obtained by kneading the glass powder with a cellulose-based binder, and a solvent such as carbitol acetate or the like is printed in form of a predetermined pattern on the surface of the mask base material 52, by a screen-printing method. Thereafter, the resultant is dried at a temperature of about 100° C. to 150° C. In this stage, the stripe-shaped insulating material layers 53 are composed of a glass component and a binder component. As the binder component, it is necessary to select a component which does not cause peeling or cracking in a subsequent step of pressing. Since the pressing of mask base material 52 is carried out at a temperature between 150° C. and 300° C., it is necessary that the binder has not only the features as described above but also does not cause decomposition. As a binder of this kind, acryl-based resin can be used in addition to cellulose-based resin.

Next, the mask base material 52, on which the insulating material layers 53 are formed, is attached to a press mold and is subjected to press molding. In this manner, a shadow mask 12 having a mask main surface 20 and a skirt part 18 with a desired shape is obtained. During the press molding, a heat-resistant oil such as silicon oil or the like is generally coated on the mold as a lubricant for elongating the lifetime of the mold. This lubricant, however, penetrates the dried insulating material layers, thereby to hinder sintering of glass. Therefore, it is desirable to perform press molding without coating a lubricant or with coating an overcoat layer 54 which is thermally decomposed at a lower temperature than the binder in the insulating material layers 53, on the entire surface of the apertured region 20*a* of the mask base material 52 or only on the insulating material layers 53, as shown in FIG. 12. Cellulose-based resin, acryl-based resin, or the like can be used as the overcoat material.

Subsequently, binder-removal process is carried out for burning out the binder in the insulating material layers 53 and for thermally decomposing the overcoat layer 5.4. Thereafter, the entire shadow mask 12 is sintered at about 500 to 650° C., so that the insulating material layers 53 are sintered thereby to form dielectric layers 50. At the same time, the surface of the shadow mask 12 is blackened.

By the processes described above, a shadow mask 12 having a predetermined shape is obtained with stripe-shaped dielectric layers 50 formed on its surface on the side facing the electron gun.

According to the above-mentioned manufacturing method, stripe-shaped insulating material layers 53 are formed before shaping the mask base material 52 into a curved shape so that these insulating material layers can be formed precisely at predetermined positions. In addition, no position shift of the insulating material layers 53 is caused during or after the press molding. Therefore, it is possible to improve sufficiently positional preciseness of the dielectric layers 50 which are finished finally. Further, the forming positions, width, and height of the dielectric layers 50 can be controlled easily by using screen-printing.

Further, the overcoat layer 54 is formed before press molding so that penetration of a lubricant oil is prevented. As a result, it is possible to prevent deterioration in crystallization of the dielectric layers 50 and peeling of the dielectric layers 50 after sintering. After press molding, most of the overcoat layer 54 is burnt out by the binder-removal process described above and the heat of the sintering process. Also, the overcoat layer 54 is washed by a later washing step, so that operation of the color cathode ray tube is not influenced therefrom.

Additional advantages and modifications will readily occur to those skilled in the art. Therefore, the invention in its broader aspects is not limited to the specific details and representative embodiment shown and described herein. Accordingly, various modifications may be made without departing from the spirit or scope of the general inventive concept as defined by the appended claims and their equivalents.

For example, the above embodiment is structured such that one dielectric layer 50 is provided in each of two sides of each aperture column. As shown in FIG. 13, however, plural dielectric layers 50, e.g., two dielectric layers 50 may be provided in each of the two sides of each aperture column.

According to this structure, the time to charge/discharge the dielectric layers 50 can be shortened. That is, electrons charged to the dielectric layers 50 must immediately be discharged after completion of operation of the color cathode ray tube. Further, in order to fasten the speed of discharging, electrons must immediately move to the shadow mask so that electrons on the dielectric layers 50 are reduced, after completion of collision of electron beams. If the discharging time is long, an unnecessary afterimage appears on the screen undesirably.

Hence, if plural dielectric layers 50 are provided in each of both sides of each aperture column as described above, the same convergence effect as described above can be obtained even when the width, height, and the like of each dielectric layer are reduced, compared with the case of providing only one dielectric layer in each side. Further, by reducing the width, height, and the like of each dielectric layer, the electrons charged to the surfaces of the dielectric layers move over a shorter distance on the surfaces to reach the shadow mask. As a result, the discharging time can be shortened. Accordingly, occurrences of unnecessary afterimages can be reduced.

In addition, the shape of each aperture formed in the shadow is not limited to a rectangular shape but may be circular. The phosphor layers in the side of the phosphor screen are not limited to stripe-shaped. layers but may be dot-shaped layers. Further, the dielectric layers need only be provided on both sides of each aperture so as to form a four-pole lens. Hence, the dielectric layers are not limited to stripe-shaped layers but may each be patterned into a predetermined shape such as an island-shape, a dot-shape, or the like. Likewise, the size and shape of every component suggested in the embodiment described above are merely examples and may therefore be modified variously upon requirements.

Further, in the present invention, the shadow mask serving as a color selection electrode is not limited to a press-molded mask but may be a tensioned mask on which tension is effected.

INDUSTRIAL APPLICABILITY

The present invention has been made in view of the above problems and its object is to provide a color cathode ray tube and a method of manufacturing the same, which improve the focus characteristic of electron beams over the entire screen area so that the luminance of the entire screen can be improved.

What is claimed is:

1. A color cathode ray tube comprising:

an envelope including a panel with a phosphor screen formed on an inner surface of the panel;

an electron gun arranged in the envelope, for emitting electron beams toward the phosphor screen;

a shadow mask which is provided facing the phosphor screen and has a number of apertures for selecting the electron beams, the apertures including a plurality of aperture columns arranged substantially in parallel to one another with intervals; and dielectric layers provided on a surface of the shadow mask on a side facing the electron gun and formed in stripes extending substantially in parallel with the aperture columns, the dielectric layers being positioned on both sides of each of the apertures to be charged by irradiation of the electron beams and to form an electron lens for acting the electron beams, the dielectric layers having an average surface roughness of 0.2 $\mu$m or less, a dielectric constant of 3 or more, and a volume resistivity of 1.0E+12 to 1.0E+15 Ω·cm.

2. The color cathode ray tube according to claim 1, wherein the dielectric layers include a part having a maximum layer thickness of 10 $\mu$m or more.

3. The color cathode ray tube according to claim 1, wherein the shadow mask includes a substantially rectangular apertured region in which the apertures are formed and which has a long axis and a short axis perpendicular to each other and penetrating a tube axis, and each of the aperture columns includes a plurality of substantially rectangular apertures which are arranged in the short axis direction of the apertured region and each of which has a width in the long axis direction of the apertured region.

4. The color cathode ray tube according to claim 3, wherein the phosphor screen includes stripe-shaped phosphor layers extending in substantial parallel to the short axis of the shadow mask.

5. The color cathode ray tube according to claim 1, wherein the dielectric layers are formed of an insulating material containing glass as a main component.

6. The color cathode ray tube according to claim 5, wherein the dielectric layers are formed, containing at least one of lithium-based alkaline borosilicate glass, bismuth-based borosilicate glass, and lead glass, as a main component.

7. The color cathode ray tube according to claim 1, wherein the dielectric layers have a surface roughness of 0.15 $\mu$m or less.

8. The color cathode ray tube according to claim 1, wherein the dielectric layers have a dielectric constant of 5 or more.

9. The color cathode ray tube according to claim 1, wherein the dielectric layers have a volume resistivity of 5.0E+12 to 7.5E+14 Ω·cm.

10. A color cathode ray tube comprising:

an envelope including a panel with a phosphor screen formed on an inner surface of the panel;

an electron gun arranged in the envelope, for emitting electron beams toward the phosphor screen;

a shadow mask which is provided facing the phosphor screen and has a number of apertures for selecting the electron beams, the apertures including a plurality of aperture columns arranged substantially in parallel to one another with intervals; and dielectric layers provided on a surface of the shadow mask on a side facing the electron gun and formed in stripes extending substantially in parallel with the aperture columns, the dielectric layers being positioned on both sides of each of the apertures to be charged by irradiation of the electron beams and to form an electron lens for acting the electron beams, wherein layout positions of the dielectric layers in relation to the aperture columns differ between a center part of the apertured region and a peripheral part of the apertured region in a direction of the long axis.

11. The color cathode ray tube according to claim 10, wherein plural ones of the stripe-shaped dielectric layers are provided on each of both sides of each of the aperture columns.

12. The color cathode ray tube according to claim 10, wherein the dielectric layers provided at the peripheral part of the apertured region in the direction of the long axis are arranged closer to the center part with respect to the aperture columns than the dielectric layers provided at the center part of the apertured region.

13. A color cathode ray tube comprising:

an envelope including a panel with a phosphor screen formed on an inner surface of the panel;

an electron gun arranged in the envelope, for emitting electron beams toward the phosphor screen;

a shadow mask which is provided facing the phosphor screen and has a number of apertures for selecting the electron beams, the apertures including a plurality of aperture columns arranged substantially in parallel to one another with intervals; and dielectric layers provided on a surface of the shadow mask on a side facing the electron gun and formed in stripes extending substantially in parallel with the aperture columns, the dielectric layers being positioned on both sides of each of the apertures to be charged by irradiation of the electron beams and to form an electron lens for acting the electron beams, wherein the dielectric layers provided at a center part of the apertured region each have a width different from that of the dielectric layers provided at a peripheral part of the apertured region in the direction of the long axis.

14. The color cathode ray tube according to claim 13, wherein plural ones of the stripe-shaped dielectric layers are provided on each of both sides of each of the aperture columns.

15. A method of manufacturing a color cathode ray tube comprising an envelope including a panel with a phosphor screen formed on an inner surface of the panel; an electron gun arranged in the envelope, for emitting electron beams toward the phosphor screen; a shadow mask which is provided facing the phosphor screen and has a plurality of aperture columns provided in substantially parallel and each including a plurality of apertures arranged at a predetermined interval, to select the electron beams emitted from the electron gun; and stripe-shaped dielectric layers provided on a surface of the shadow mask on a side facing the electron gun, the dielectric layers being arranged on both sides of each of the aperture columns and extending substantially in parallel to the aperture columns to be charged by irradiation of the electron beams and to form an electron lens which acts on the electron beams, the method comprising:

preparing a plate-like mask base material in which the apertures columns are formed;

forming stripe-shaped insulating material layers on both sides of each of the apertures on a surface of the mask base material facing the electron gun;

forming an overcoat layer, which prevents penetration of a lubricant oil, on the stripe-shaped insulating material layers;

press-molding the mask base material on which the insulating material layers and the overcoat layer are formed, into a predetermined shape, thereby to form the shadow mask; and sintering the insulating material layers on the shaped shadow mask, to form the dielectric layers.

16. The method according to claim 15, wherein an insulating material containing glass as a main component is screen-printed to form the insulating material layers.

* * * * *